US005097107A

United States Patent [19]

Watkins et al.

[11] Patent Number: 5,097,107

[45] Date of Patent: * Mar. 17, 1992

[54] MICROWAVE CORN POPPING PACKAGE HAVING FLEXIBLE AND EXPANDABLE COVER

[75] Inventors: James D. Watkins, Prior Lake; Lawrence C. Brandberg, Crystal; Jeffrey T. Watkins, St. Paul; Charles H. Turpin, Minneapolis; Denise E. Hanson, Elk River, all of Minn.

[73] Assignee: Golden Valley Microwave Foods,Inc., Edina, Minn.

[ * ] Notice: The portion of the term of this patent subsequent to Apr. 16, 2008 has been disclaimed.

[21] Appl. No.: 552,798

[22] Filed: Jul. 13, 1990

Related U.S. Application Data

[63] Continuation-in-part of Ser. No. 497,190, Mar. 22, 1990, Pat. No. 5,008,024.

[51] Int. Cl.[5] ..... H05B 6/80; B65D 81/34

[52] U.S. Cl. ..... 219/10.55 E; 219/10.55 F; 426/107; 426/113; 426/234; 426/243; 99/DIG. 14

[58] Field of Search ..... 219/10.55 E, 10.55 F, 219/10.55 R; 426/106, 107, 111, 113, 115, 234, 241, 243; 99/DIG. 14, 323.4, 323.5

[56] References Cited

U.S. PATENT DOCUMENTS

| | | | |
|---|---|---|---|
| 2,673,805 | 3/1953 | Colman | 99/171 |
| 2,815,883 | 12/1957 | Robins et al. | 220/66 |
| 2,819,976 | 1/1958 | Hines | 99/171 |
| 3,140,034 | 10/1961 | Wyman et al. | 229/3.5 |
| 3,519,439 | 7/1970 | Dunn | 99/171 |
| 3,671,270 | 8/1970 | Jehn | 99/171 |
| 3,782,976 | 1/1974 | Maier | 426/110 |
| 3,969,535 | 7/1976 | Bourns | 426/111 |
| 4,038,425 | 7/1977 | Brandberg et al. | 426/107 |
| 4,190,757 | 2/1980 | Turpin et al. | 219/10.55 E |
| 4,210,674 | 7/1980 | Mitchell | 426/107 |
| 4,233,325 | 11/1980 | Slangan et al. | 426/107 |
| 4,279,933 | 7/1981 | Austin et al. | 426/124 |
| 4,398,077 | 8/1983 | Freedman et al. | 219/10.55 E |
| 4,399,159 | 8/1983 | Guibert | 426/113 |
| 4,453,665 | 6/1984 | Roccaforte | 229/41 B |
| 4,571,337 | 2/1986 | Cage | 426/107 |
| 4,584,202 | 4/1986 | Roccaforte | 426/111 |
| 4,586,649 | 5/1986 | Webinger | 229/114 |
| 4,612,431 | 9/1986 | Brown et al. | 219/10.55 E |
| 4,641,005 | 2/1987 | Sieferth | 219/10.55 E |
| 4,661,671 | 4/1987 | Maroszek | 219/10.55 E |
| 4,663,506 | 5/1987 | Bowen et al. | 219/10.55 E |
| 4,678,882 | 7/1987 | Borher | 219/10.55 E |
| 4,701,585 | 10/1987 | Stewart | 219/10.55 E |
| 4,734,288 | 3/1988 | Engstrom et al. | 426/107 |
| 4,735,513 | 4/1988 | Watkins et al. | 383/116 |
| 4,861,958 | 8/1989 | Borher | 219/10.55 E |
| 4,959,231 | 9/1990 | Lakey et al. | 426/111 |
| 5,008,024 | 4/1991 | Watkins | 219/10.55 E |

OTHER PUBLICATIONS

Jiffy Pop Microwave Popping Package, American Home Products, Inc., ©1986.

*Primary Examiner*—Philip H. Leung
*Attorney, Agent, or Firm*—James V. Harmon

[57] ABSTRACT

The invention provides a package for popping popcorn in a microwave oven including an open-topped wide mouth container in the form of a tub or bowl formed from self-supporting, i.e. stiff, microwave transparent sheet material such as stiff paper or paperboard with a flexible and expandable cover. A layer of microwave interactive susceptor material is distributed across the bottom wall of the tub to assist in popping the popcorn. Unpopped popcorn within the tub is packaged in a sealed inner compartment or container within the tub. During cooking, the flexible cover expands upwardly as the kernels pop so as to accommodate their expansion.

13 Claims, 2 Drawing Sheets

MICROWAVE CORN POPPING PACKAGE HAVING FLEXIBLE AND EXPANDABLE COVER

This is a continuation-in-part of application Ser. No. 497,190 filed May 22, 1990m now U.S. Pat. No. 5,008,024 and bearing the same title.

FIELD OF THE INVENTION

The invention relates to microwave packaging and especially to a package suited for popping popcorn in a microwave oven.

BACKGROUND OF THE INVENTION

U.S. Pat. Nos. 4,861,958 and 4,678,882 describe a popcorn popping container in the form of a paperboard cup with a microwave lossy element added to the bottom of the cup either as a separate disc or as a laminate and with a lid having appertures for releasing moisture produced during popping. While the lossy element is intended to assist in popping the corn, neither the volume of popped corn produced nor the percentage of unpopped kernels have been as good as desired. Users are particularly disturbed when a substantial number of unpopped kernels or "old maids" remain after the popping process. It is therefore one object of the invention to make an improvement in the volume of popped corn and unpopped kernels produced in a package having the general form described in the aforesaid patents.

U.S. Pat. No. 4,586,649 describes a poping package in which the bottom of the package slopes centrally toward a central panel of small size. The carton resembles two truncated pyramids which are joined base-to-base and supported on a separate stand in the form of a collapsible tube. The sloping lower portion of the carton causes the corn to bunch together in a clump. In addition, the supporting stand must be manipulated by hand. This requires extra attention by the user and in the present state of development of the art is considered to be unsatisfactory because of the extra time, care and attention needed in setting up the package for popping. Moreover, many users have trouble following directions. Popping will be less satisfactory because the package also contains no susceptor. Finally, the distance between the package and the floor of the oven varies from one point to another because the bottom part of the package is sloped.

It is also known to provide a foil pan with an expandable cover for popping popcorn on a stove top. These packages are not suitable for use in a microwave oven because the metal foil pan acts as a shield. Examples are U.S. Pat. Nos. 3,519,439; 3,782,976 and 3,969,535.

Another popcorn package is described in U.S. Pat. No. 4,584,202. This package includes a paperboard carton with a top panel having a removable portion that is detached from the rest of the package just prior to popping. The unpopped popcorn is placed in a separate pouch which as it expands is pushed outside the carton through the top opening. The package contains no susceptor, and accordingly, popping of the corn will proceed at a relatively slow rate and may be incomplete. The use of a separate inner pouch makes the container more expensive. By now, the art has developed to a point at which the removal of a panel prior to popping is a deficiency that may render the product unacceptable to some users. In the course of developing the present invention it was found that the large bubble of superheated steam which collected under the flexible cover could burn the fingers when the package was opened. An attempt was made to vent the steam through vent holes. Vent holes, however, allow moisture to enter the corn and reduce popping performance. Moisture could also enter to a degree even without vent holes. Changes in corn moisture due to the gain or loss of moisture from the atmosphere was found to be a troublesome obstacle to good popping performance, both with respect to the number of unpopped kernels remaining as well as the volume of popped corn produced.

It is therefore a major object of the invention to provide an improved microwave popping package which requires no manipulation prior to use, from which popped corn can be eaten directly, which is capable of being stacked one inside another, and which provides a substantial improvement both in the volume of popped corn produced and also in the number of kernels that remain unpopped. A further object is to provide a popping package of the type described having a microwave interactive susceptor material distributed in heat conductive relationship with the popcorn and to find a way to strategically locate the entire susceptor in relationship to the supporting surface of the oven. Another object is to provide a spacing or gap between the susceptor and the oven floor that is related to the electrical characteristics of the oven for maximum energy transfer to the susceptor. It is also an object to find a way to provide a reliable hermetic seal for the corn to promote good popping of the corn as well as to vent steam without allowing moisture to enter the food through the vent holes.

These and other more detailed and specific objects of the invention will be better understood by reference to the following detailed description and figures which illustrate by way of example but a few of the various forms of the invention within the scope of the appended claims.

THE FIGURES

SUMMARY OF THE INVENTION

Figure 1:
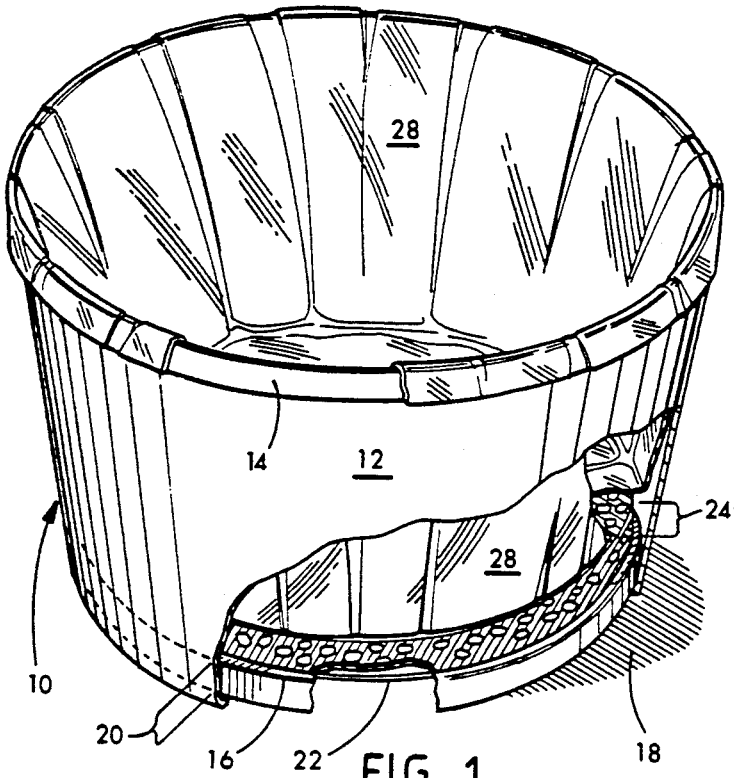
FIG. 1 is a perspective view of the invention partly broken away.

The invention provides a package for popping popcorn in a microwave oven. One major component is an open-topped wide mouth container in the form of a tub or bowl which is formed from self-supporting, preferably stiff microwave transparent sheet material such as paper or paperboard. The tub includes an upstanding side wall terminating at the top in a free edge which defines an upper wide mouth. The side walls of the tub slope outwardly to permit stacking of a plurality of such packages within one another during shipment and storage. The side walls have a lower edge which rests on the floor of the microwave oven during cooking.

The tub also includes a flat bottom wall. Above the bottom wall is a first compartment containing unpopped popcorn and optionally a quantity of vegetable oil or shortening. The bottom wall is connected to the side wall at a point spaced upwardly from its bottom edge so as to define a second compartment within the package providing an air space between the bottom wall of the package and the oven floor that has a substantially uniform height throughout. A layer of microwave interactive susceptor material is connected to the bottom wall and is distributed across the bottom wall so that the entire susceptor has a constant gap from the bottom wall of the oven to assist in popping the popcorn. The uniform height of the air gap between the susceptor and the oven floor facilitates the efficient transfer of microwave energy via the susceptor to the corn for enhancing popping of the corn.

The lower edge of the side wall of the tub is uninterrupted to make possible a sealing engagement with the floor of the microwave oven so that the air in the compartment is held below the package. As a result, the air in the air gap becomes heated above the temperature of the air in the oven which surrounds the package. This assists in the transfer of microwave energy to the susceptor. The unpopped popcorn contained in the upper compartment is in heat conductive relationship with the susceptor. A flexible cover is sealed to the top of the tub and expands upwardly as the kernels pop.

The susceptor can comprise any of a variety of microwave interactive materials such as a thin layer of metal, e.g. vapor deposited metal, metal oxide, carbon and the like known to the art. The susceptor can be applied directly to the bottom wall of the tub or can be supported upon a sheet of paper or plastic which is subsequently bonded to the bottom wall of the tub. One potentially suitable susceptor is a thin layer of plastic or paper having on it a dried layer of a liquid microwave interactive coating containing a microwave interactive component, e.g. carbon particles bonded together with a film former or matrix and microwave transparent electrically nonconductive attenuator particles. The susceptor layer can also be composed of a self-supporting coating adhered to the bottom wall and containing microwave interactive particles supported within a cured binder or matrix which holds the particles together and also bonds the susceptor coating to the surface of the bottom wall. Examples of such coatings are described in U.S. Pat. Nos. 4,267,420 and 4,190,757 and U.S. patent application Ser. Nos. 456,159 filed 12/22/89 or 261,380 filed 10/24/88.

In another form of the invention, the food is held in a sealed compartment, e.g. a hermetically sealed compartment, and vent means are provided in a second compartment separated from the sealed compartment by a releasable seal. In one preferred package the food is held in a rimmed dish or tray at the bottom of the tub or forming the bottom wall thereof. The cover is a flexible plastic film releasably sealed to the rim of the dish. During heating the seal is released, allowing the flexible cover to expand upwardly. A circular lid can be sealed to the dish beneath the cover.

DETAILED DESCRIPTION OF THE INVENTION

Figure 2:
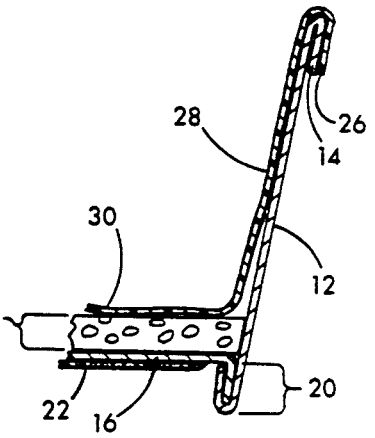
FIG. 2 is a partial vertical sectional view of a portion of the side and bottom wall of the package.

As shown in the figures, the package 10 comprises a bowl or tub-shaped container having an upstanding side wall 12 and a horizontal bottom wall 16 both of which can be formed from a stiff or semi-flexible material such as paper or paperboard. The side wall 12 is in this case circular, but other shapes are possible. As shown in FIGS. 1 and 2, the top edge of the tub is turned outwardly at 14 to define a reinforcing lip forming a circular wide mouth at the top of the side wall 12. The bottom wall 16 which is also circular is spaced upwardly from the oven floor 18 by a distance 20. The bottom wall 16 is thus bonded to the side wall 12 at a point above its lower edge 21. The bottom wall 16 can be made of stiff or flexible material such as paperboard or paper. As shown, its outer edge is folded downwardly and bonded to the side wall 12. Above the bottom wall 16 is a first compartment within the package which contains unpopped popcorn optionally mixed with a quantity of cooking oil or other shortening, indicated generally at 24.

Figure 3:
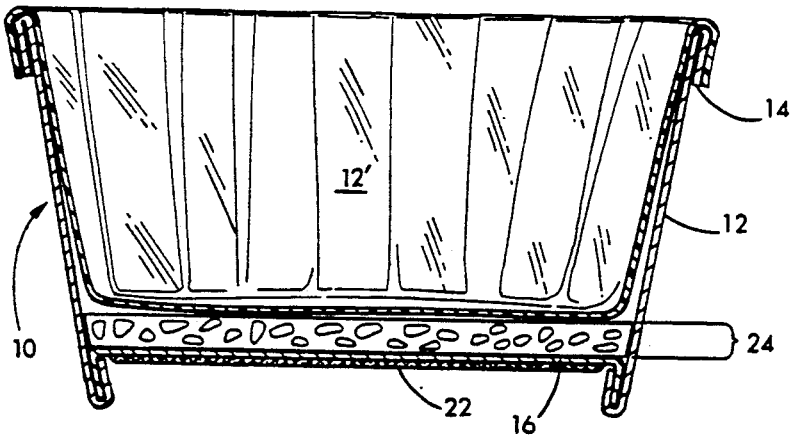
FIG. 3 is a central vertical sectional view of the package of FIG. 1.
Figure 4:
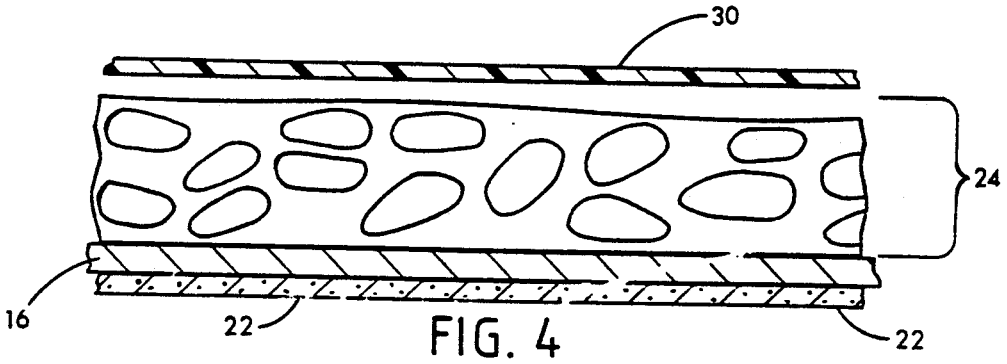
FIG. 4 is a partial vertical sectional view of the center portion of the package on a greatly enlarged scale.

The cover 12' consists of a circular sheet of flexible microwave transparent material (FIG. 3) having a portion 26 at the edge which is bonded by means of a suitable adhesive to the rim 14. The cover 12' has a peripheral portion 28 which conforms to the inner surface of the side wall 12 and a central portion 30 which rests against the upper surface of the charge of unpopped popcorn and shortening 24.

During popping, the cover 12' expands upwardly as the kernels pop until it reaches a position approximately at the elevation of the upper edge of the rim 14 or slightly above it. The size of the tub and the charge of popcorn 24 are proportioned so that the popped corn will approximately fill or slightly exceed the volume of the tub. To serve the popcorn, all that is necessary is to remove the cover 12' by separating it from the upper rim 14 of the side wall 12. The tub then functions as a serving dish or bowl from which the popcorn can be eaten directly.

Since the side wall 12 of the tub is sloped outwardly, several of such packages can be stacked within one another during shipment and storage.

A suitable microwave interactive susceptor 22 is bonded to the bottom wall 16 of the tub and distributed across the center portion but not the edge portion that is folded downwardly and bonded to the lower part of side wall 12. It will be seen that both the bottom wall 16 and the susceptor 22 are positioned horizontally during use and are parallel to the floor of the oven 18. It will also be seen that the spacing between the bottom wall 16 and the bottom edge 21 of the side wall 12 defines a second compartment within the package below the bottom wall 16 to provide an air space between the bottom wall 16 of the package and the oven floor 18. This air space has a substantially uniform height throughout. As a result, the microwave interactive susceptor 22 connected to the bottom wall is positioned such that substantially the entire susceptor 22 has a constant gap G from the floor 18 of the microwave oven.

The lower edge 21 of the side wall 12 is uninterrupted to provide a sealing engagement with the floor of the microwave oven. As a result, air in the lower compartment is held within the confines of the side wall 12 and below the bottom wall 16. Air in the lower compartment will become heated during cooking above the temperature of the air in the oven. Because the gap G is of constant height their will be provided beneath the susceptor 22 a heated layer of air that serves as a dielectric layer having a constant height (gap G) throughout the entire susceptor 22. It is known that the dielectric constant of a substance will affect the microwave energy distribution through it. When the air in the gap G becomes heated, its dielectric constant will change primarily as a result of the expansion due to heating and the resulting reduction in the moisture content of the heated air. It is believed that the uniformity of the heated air layer in the gap G acting with the reduction in the dielectric constant of the air as it becomes heated helps to assure maximum microwave energy transfer to the susceptor 22.

Because microwave energy is reflected from surfaces, it has been found that energy peaks or nodes can occur at predetermined distances from a surface, as for example a predetermined distance from an oven wall that is partially or completely reflective of microwave energy.

In one form of the invention bottom wall 16 and susceptor 22 are placed at a strategic distance above the bottom edge 21 of the side wall 12 which is related to the electrical characteristics of the microwave energy. For example, in one form of the invention, the gap G is about one-eighth wavelength of the microwave energy supplied to the oven so that when the oven has a wavelength of 12 cm (which is typical of almost all ovens), the gap G is about 1.0 cm to 1.5 cm and preferably about 1.25 cm. In this way substantially the entire susceptor 22 has a constant gap G between itself and the floor of the oven 18, namely, about one-eighth of the wavelength of the microwave energy supplied to the oven. With respect to energy reflected upwardly onto the susceptor 22, there can thus be an energy reinforcement region or node which coincides with the location of the susceptor 22 which helps further to transfer the microwave energy efficiently to the susceptor 22 and then to the popcorn.

The effectiveness of the invention is shown in the following comparative examples. In each example a tub was formed from food grade paperboard. A cover was formed from a sheet of polyester film bonded with adhesive to the rim of the tub. The tubs were each loaded with 56 grams of unpopped popcorn and 23.5 grams of vegetable oil. In each case popping was accomplished in a 700 watt Litton microwave oven for 2 minutes and 35 seconds.

EXAMPLE 1—THE INVENTION

This example demonstrates the results achieved with the invention as shown in the figures. The bottom wall 16 was placed about 7/16 inches (1.25 cm) above the lower edge 21 of the side wall 12 to provide a gap G between the susceptor 22 and the floor of the oven 18 of 1.25 cm. The oven had a wavelength of 12 cm. The results obtained in all examples are shown in Table 1 below.

COMPARATIVE EXAMPLE 2

A package was prepared the same as in Example 1 except that the portion of the side wall 12 extending below the bottom wall 16 was removed so that the bottom wall and susceptor rested against the floor of the oven.

COMPARATIVE EXAMPLE 3

A tub was prepared as in Example 1 except that portions of the side wall 12 below the bottom wall 16 were cut away and removed to leave four spaced apart remnants of the side wall which served as legs to hold the susceptor 22 the same distance from the oven floor as in Example 1 but allowed air to circulate freely beneath the susceptor.

COMPARATIVE EXAMPLE 4

A sample was prepared as in Example 1 except that no susceptor was provided. The results are shown in the following table.

TABLE 1

| | RESULTS | | |
|---|---|---|---|
| | Volume of Popped Corn (ml) | Unpopped Kernels (g) | Unpopped Kernels (%) |
| Example 1 - Invention (G = 1.25 cm) | 2100 | 1.04 | 1.9 |
| Comparative Example 2: Bottom wall rests on oven floor (G = 0 cm) | 1900 | 7.43 | 13.3 |
| Comparative Example 3: Air allowed to circulate below susceptor (G = 1.25 cm) | 1950 | 4.05 | 7.2 |
| Comparative Example 4: No susceptor (G = 1.25 cm) | 1950 | 4.80 | 8.6 |

As can be seen in the table, the volume of popped corn that resulted from the invention was 2100 ml, or 150 ml greater than examples 3 and 4 and 200 ml greater than Example 2. This improvement provides the consumer with a substantially greater volume of popped corn. Even more importantly, the invention results in only 1.9% unpopped kernels. By comparison, Examples 2, 3 and 4 result in a much greater percentage of unpopped kernels, namely 13.3%, 7.2% and 8.6%, respectively. In other words, the number of kernels that remained unpopped in Example 3 is about 370% greater than the invention, and Example 4 is about 450% greater than the invention.

The air in the lower compartment beneath the susceptor in Example 1 reached a temperature of 198.4° C. after being heated for 2 minutes, 35 seconds. When no susceptor was used, the air in the compartment reached a temperature of 128.7° C. In the meantime, the air in the oven outside the package was raised from a temperature of about 20° C. before cooking to about 49.5° C. This shows that the air in the compartment beneath the susceptor is about 159° C. hotter than the air in the oven and about 70° C. hotter than achieved with a similar package having no susceptor. This provides a change in the dielectric constant of the air through a gap of uniform height G between the susceptor and the oven floor which assists in the efficient transfer of microwave energy to the susceptor and to the popcorn.

It will be noted that the package does not have to be manipulated in any way prior to popping. It also provides a package from which the popcorn can be easily consumed directly, i.e. without the necessity of transferring it to another container. In addition, the popping performance as measured by the volume of popped kernels and the reduction in the number of unpopped kernels is substantially improved.

Figure 5:
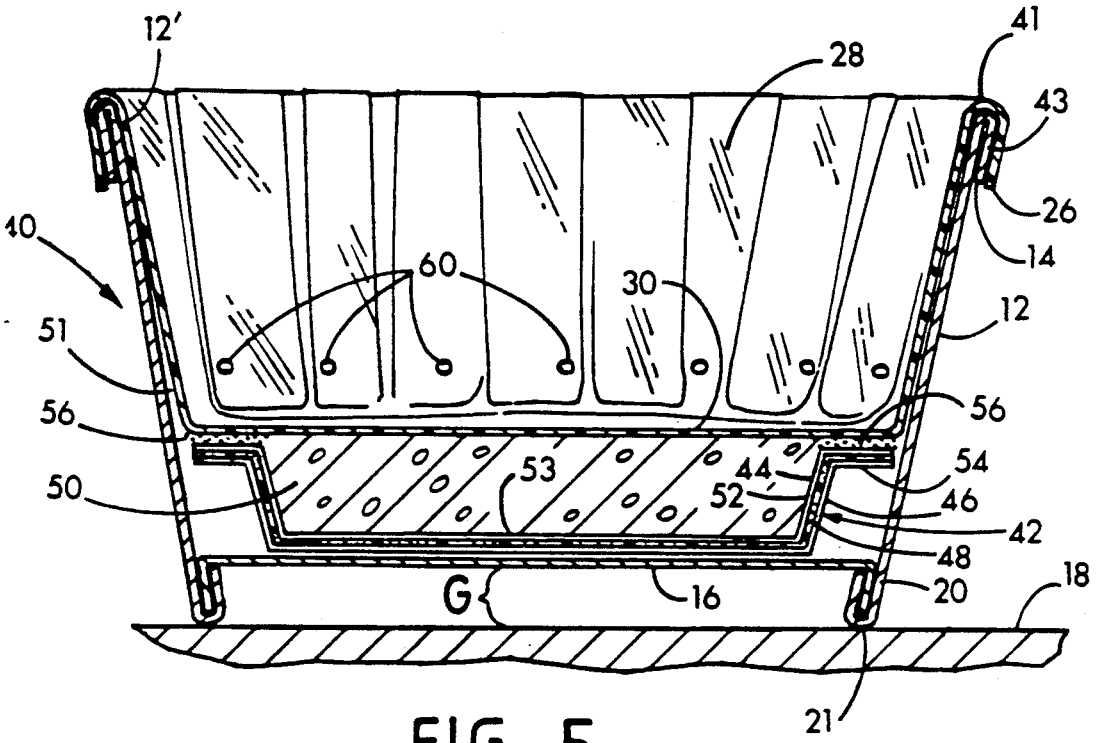
FIG. 5 is a vertical sectional view of another form of the invention.

Refer now to FIG. 5 which illustrates a modified form of the invention wherein the same numerals refer to corresponding parts already described. As shown in the figure, the package indicated generally at 40 includes a circular sidewall 12 which tapers outwardly proceeding toward the top edge 41 which defines an upper open wide mouth similar to that already described. It will be noted that the upper edge of the flexible cover 12' is sealed at 43' to the upper edge of the sidewall 12 to L provide a first seal for the cover 12'. The package 40 also includes a bottom wall 16 having a downwardly turned peripheral collar 20 that is sealed to the lower edge portion 21 of the sidewall 12 to define an air chamber of constant height for providing an air gap G between the floor of the oven 18 and the bottom wall 16 of the container. In this case, food, e.g. a popcorn-containing dish 42, is provided within the package 40 with its lower surface resting on the bottom wall 16. The dish 42 can be composed of any suitable microwave transparent self-supporting material such as paper, paperboard or plastic. In the form shown, the dish 42 comprises a pair of inner and outer paper or paperboard layers 44, 46. The outer paperboard layer 46 in this case comprises a 282 lb. per ream paperboard layer, while the inner paper layer comprises 21 lb. greaseproof paper. Between the layers 44 and 46 is an intermediate susceptor layer 48 composed in this case of plastic film, such as a 0.48 mil metallized polyester film which is semiconductive and adapted to absorb microwave energy to heat the food (popcorn) indicated at 50. The susceptor 48 can comprise any of the susceptor materials described above or generally known to those skilled in the art. One suitable susceptor comprises a semiconductive aluminum layer applied by vacuum electrodeposition to one surface of a 2 mil polyester film. The layers 44–48 of the dish are bonded together with a suitable adhesive such as a polyvinylacetate emulsion adhesive, e.g. Duracet-12 adhesive by Franklin Internation, Inc. of Columbus, Ohio.

It will be noted that the dish 42 includes a bottom wall 53, an outwardly tapering sidewall 52, and a horizontal circular rim 54. In one preferred form of the invention, only the bottom wall 53 and the rim 54 are provided with microwave absorbing susceptor material, the sidewall 52 being free of susceptor material, e.g. by having the susceptor substance, e.g. metal, removed from susceptor layer 48.

Between the rim 54 and the center portion 30 of the flexible cover 12' is a second seal, in this case an annular heat-releasable seal 56. The adhesive 56 can be any suitable thermoplastic adhesive which is adapted to soften at elevated temperature. One suitable adhesive is a temperature activated, i.e. hot-melt, adhesive designated Scotch Pack ® #122 by The 3M Company of St Paul, Minn., which is activated at about 225° F. to 375° F. It will be noted that the second cover seal 56 extends all the way around the circular rim 54 at the mouth or upper edge of the dish 42. The releasable seal 56 thus provides a hermetic seal for the food-containing space to reduce moisture transfer to or from the popcorn 50. It has been found that the popcorn 50 will, as a result, keep its good popping qualities after being stored for a substantial period of time.

Located in the flexible cover 12' just above the dish 42 is an empty, in this case collapsed, compartment 51 (located between the wall 12 and the cover 12') having a plurality of steam vent openings 60, e.g. 1/16th inch diameter holes. It will be seen that since the steam vent openings 60 are in the compartment 51 above the seal 56, they do not provide a path for moisture to enter or leave the sealed dish 42.

To use the package of FIG. 5, it is placed in a microwave oven and exposed to microwave energy. This heats the popcorn 50, causing it to pop. Additional heat is provided by the susceptor 48 in the dish 42 to enhance the popping of the corn. The bottom of the dish 42 will typically become heated to between 300° F. and 450° F. by the susceptor layer 48. In addition, the susceptor material 48 within the rim 54 will heat the releasible adhesive in seal 56, allowing the cover 12' to rise as moisture vapor expands within the package during the heating process.

It should also be noted that once the seal 56 is broken, the evolved steam can easily escape through the vent holes 60. Prior to this time, however, the hermetic seal 56 between the cover 28 and the periphery of the food containing compartment of the dish 42 will prevent moisture transfer to or from the popcorn 50 so as to assure reliable popping. In addition, the controlled venting of the container made possible by the openings 60 dissipates the bubble of steam which otherwise forms in the container and, if present, could burn the fingers as the package was opened. It can also be seen that the sidewall 12 of the tub itself does not have to be a vapor barrier since the popcorn 50 is enclosed between the center portion 30 of cover 12' and the dish 42. The tub can consequently be made of a less expensive material.

Figure 6:
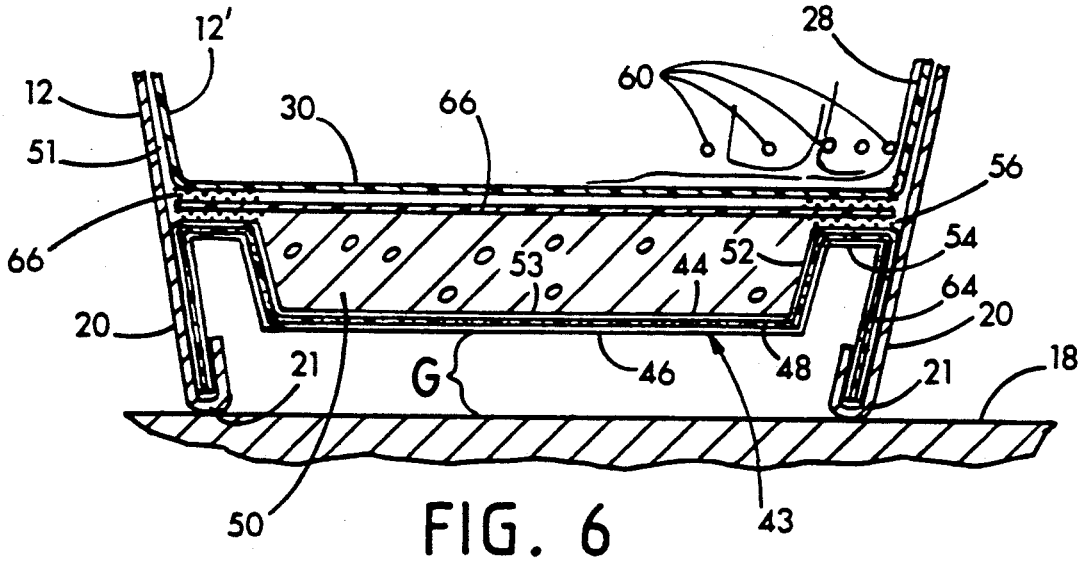
FIG. 6 is a partial vertical sectional view of another form of the invention.

Refer now to FIG. 6. The package of FIG. 6 is generally similar to FIG. 5 except that the bottom wall 16 has been eliminated by providing a downward circular collar 64 at the outer edge of the rim 54. The dish in this case is designated 43. Additionally, a circular lid 66 of any suitable barrier material such as plastic film, e.g. polyvinyladene coated polyester film, is sealed to the rim 54 by means of the releasable seal 56 comprising any suitable thermoplastic adhesive. The lid 66 can be composed of any other suitable plastic material known for its low moisture vapor transmissivity to reduce moisture vapor transmission to or from the popcorn 50. The cover 12', however, can be composed of a less expensive plastic material which need not have vapor barrier qualities. While it is not essential, it is preferred that the flexible cover 12' be bonded, e.g. by means of adhesive 67, to the edge or to other portions of the lid 66.

The package of FIG. 6 operates in the same manner as that described in FIG. 5. When the microwave energy heats the package and pressure develops within the chamber containing the popcorn 50, the seal 56 will eventually rupture, allowing the cover 12' to rise upwardly due to the expansion of hot air and vapor within the package. As the cover 12' rises to accommodate the expansion of the popping coren, steam escapes through the vent openings 60. Prior to popping, however, the popcorn 50 within the dish 43 is hermetically sealed to insure good popping characteristics.

The embodiment of FIG. 5 requires somewhat more material than that of FIG. 6 but can be assembled more readily from performed tubs and will usually be somewhat stronger due to the presence of the bottom wall 16. The embodiment of FIG. 6, however, requires less material and is therefore lower in cost.

Many variations of the present invention within the scope of the appended claims will be apparent to those skilled in the art once the principles described herein are understood.

What is claimed is:

1. A package for popping popcorn in a microwave oven having an oven chamber with a floor, the package comprising, a container formed from self-supporting microwave transparent sheet material and including an upstanding side wall terminating at the top in a free edge defining an upper mouth, the side walls of the package slope outwardly to permit stacking of a plurality of such packages within one another during shipment and storage, the side wall having a lower edge resting upon the floor of the microwave oven during cooking, the package also including a generally horizontal wall portion to provide a compartment thereabove for unpopped popcorn, the horizontal wall positioned at a point spaced upwardly from the bottom edge of the side wall to define a second compartment within the confines of the side wall between the bottom wall of the package and said oven floor, a layer of a microwave interactive susceptor material connected or adjacent to the horizontal wall and being distributed thereacross, the lower edge of the side wall of the container provides sealing engagement with the floor of the microwave oven whereby air in the lower compartment is held therein so as to become heated above the temperature of the surrounding air in the oven, a layer of popcorn contained in the upper compartment of the container in heat conductive relationship with the susceptor, a flexible cover formed from flexible microwave transparent material, a first seal between the cover and the sidewall proximate to upper wide mouth, said cover conforming prior to popping to the inner surface of the container and generally in proximity to the upper surface of the layer of unpopped corn, at least one layer of a flexible barrier material extending across the upper aspect of the popcorn, a heat releasable hermetic seal between the flexible barrier material and a portion of the package enclosing the popcorn, whereby during heating said releasable seal is ruptured enabling said flexible cover to expand upwardly as the popcorn pops to accommodate kernels of popped corn, and prior to rupturing the hermetic seal maintains a protective enclosure for the popcorn for enhancing popping of the corn.

2. The package of claim 1 wherein the susceptor comprises a dried layer of a liquid microwave interactive coating applied to the lower surface of said bottom wall.

3. The package of claim 1 wherein the susceptor is a thin layer of metal or a metal-containing composition.

4. The package of claim 1 wherein a popcorn containing container is provided within the package, said popcorn containing container having a rim that includes a microwave susceptor material adapted to assist in melting the releasable seal during microwave heating to facilitate the release of the cover from the rim.

5. The package of claim 4 wherein the susceptor layer comprises a coating adhered to the lower surface of the popcorn containing container, said susceptor including particles of a microwave interactive substance and a cured binder to hold the particles together and to bond the coating to the surface of the popcorn containing container.

6. The package of claim 4 wherein the popcorn containing container is spaced upwardly from the lower edge f the side wall by a distance of about one-eighth wavelength of the microwave energy supplied to the oven so that when the oven has a wavelength of 12 cm said distance is about 1.0 cm to 1.5 cm whereby the entire susceptor has a gap G of about one-eighth wavelength of the microwave energy between itself and the bottom wall of the oven to assist in popping the popcorn.

7. The package of claim 4 wherein the popcorn containing container is a dish-shaped container having a bottom wall, a side wall and a circular rim at the upper edge of the side wall, said susceptor is provided in heat transfer relationship with the rim, a lid composed of a barrier sheet material is sealed to the rim by means of said heat releasable seal, the food contained in the popcorn containing container expands during heating in the microwave oven and, upon release of said seal, transfers into an upper compartment, said upper compartment has an expandable wall formed by said flexible cover to accommodate the expansion of the food from the popcorn containing container as it transfers during heating into the upper compartment.

8. The package of claim 7 wherein the bottom wall of the popcorn containing container has a susceptor layer of microwave interactive material to assist in heating the food therein.

9. The package of claim 8 wherein the food comprises kernels of unpopped popcorn.

10. The package of claim 1 wherein the heat releasable hermetic seal has microwave susceptor material adapted to assist in melting the releasable seal during microwave heating to facilitate the release of the cover from the rim.

11. The package of claim 1, wherein the side wall of the container has said cover connected thereto, said cover is formed from a flexible sheet material adapted to expand upwardly during heating in a microwave oven and the upward expansion of the cover encloses and accommodates food when expanded by the application of microwave energy to the package.

12. The package of claim 1 wherein a dish-shaped container is located within the upper compartment, the popcorn is contained within the dish-shaped container and said layer of flexible barrier material comprises a sheet of material sealed across the top of the dish-shaped container above the popcorn and the layer of microwave interactive susceptor material is connected to the dish-shaped container in heat transfer relationship to the popcorn therein.

13. The package of claim 12 wherein the flexible cover is bonded to the layer of flexible barrier

* * * * *

UNITED STATES PATENT AND TRADEMARK OFFICE

CERTIFICATE OF CORRECTION

PATENT NO. : 5,097,107

DATED : MARCH 17, 1992

INVENTOR(S) : WATKINS ET AL.

It is certified that error appears in the above-identified patent and that said Letters Patent is hereby corrected as shown below:

In claim 13 (column 10, line 52):

after "barrier" insert ---material---.

Signed and Sealed this

Fourth Day of January, 1994

Bruce Lehman

*Attest:*

BRUCE LEHMAN

*Attesting Officer*

*Commissioner of Patents and Trademarks*